US005412829A

United States Patent [19]

Hefner

[11] Patent Number: 5,412,829

[45] Date of Patent: May 9, 1995

[54] TILE GROUT SCRUBBER

[76] Inventor: Esther L. Hefner, 5982 Set-N-Sun Pl., Jupiter, Fla. 33458

[21] Appl. No.: 265,924

[22] Filed: Jun. 27, 1994

[51] Int. Cl.[6] ..... A47L 11/282; A47L 11/24; A46B 7/00; A46B 9/10

[52] U.S. Cl. ..... 15/52.1; 15/160; 15/172; 15/210.1; 15/244.1

[58] Field of Search ..... 15/160, 166, 172, 176.1, 15/176.6, 186, 210.1, 236.06, 244.1, 52.1

[56] References Cited

U.S. PATENT DOCUMENTS

| | | | |
|---|---|---|---|
| 531,433 | 12/1894 | Brooks | 15/160 |
| 2,604,649 | 7/1952 | Stephenson | 15/185 |
| 2,677,840 | 5/1954 | Morton | 15/160 |
| 4,255,827 | 3/1981 | Palazzo | 15/160 |
| 5,319,824 | 6/1994 | Cook, III | 15/160 |

FOREIGN PATENT DOCUMENTS

| | | | |
|---|---|---|---|
| 585946 | 10/1933 | Germany | 15/166 |

*Primary Examiner*—Edward L. Roberts, Jr.
*Attorney, Agent, or Firm*—Alvin S. Blum

[57] ABSTRACT

To scrub adjacent parallel grout lines on a tile floor simultaneously, a long handle is attached to a base which is wider than the space between adjacent grout lines. Two or more long narrow scrubbing elements are adjustably mounted on the base with the long sides parallel to one another. They are spaced apart to correspond to the spacing between tiles and locked in position. When they are moved back and forth in a scrubbing motion, they tend to remain in the depressed grout lines so they are self-guiding. All the scrubbing effort is directed to the grout lines which tend to accumulate dirt more than the elevated, impervious tile surface. The scrubbing elements may be bristle brushes, foam or fibrous scrubbing material. An electric motor driven embodiment is shown with rotary brushes adjustably mounted on a rotary shaft.

17 Claims, 1 Drawing Sheet

FIG. 7
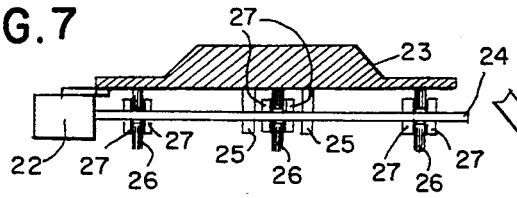
FIG. 6
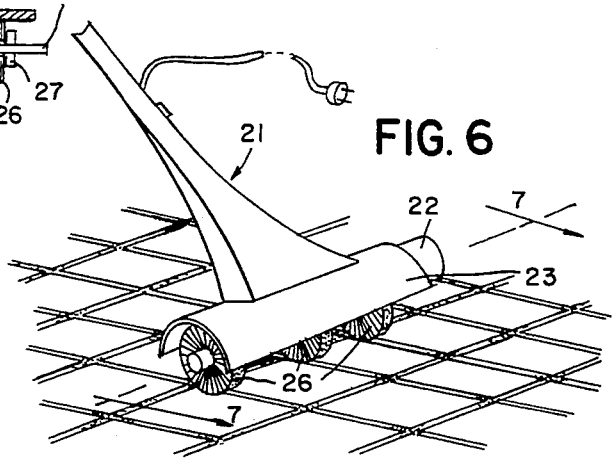
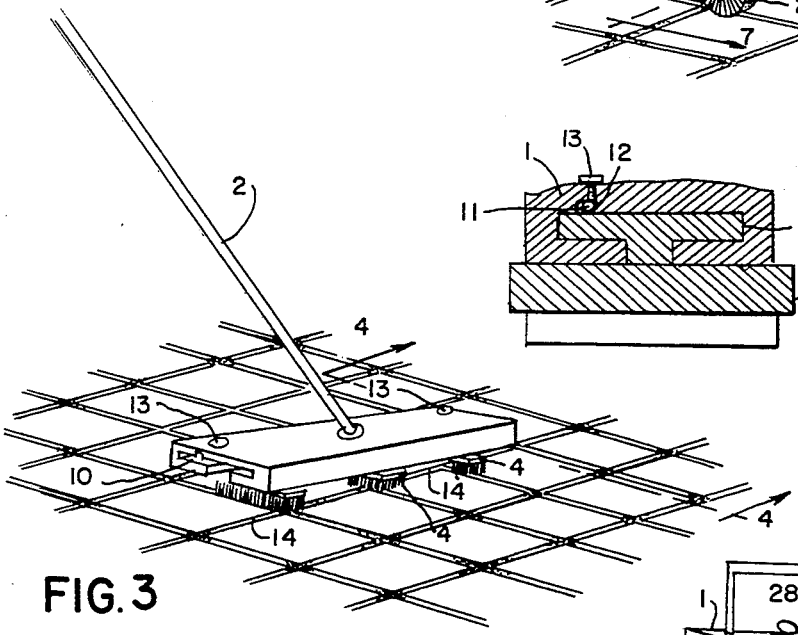
FIG. 3
FIG. 4
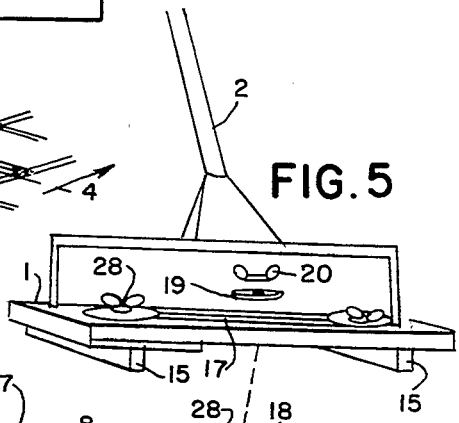
FIG. 5
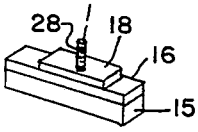
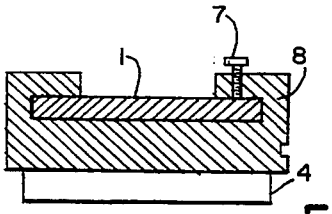
FIG. 2
FIG. 1
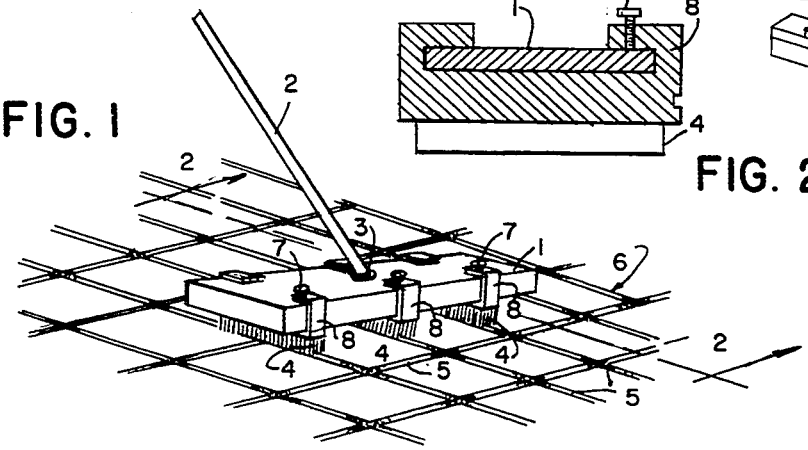

TILE GROUT SCRUBBER

BACKGROUND OF THE INVENTION

This invention relates to cleaning implements and more particularly to scrubbers for cleaning the grout between tiles.

Floor tile surfaces are generally made to be resistant to soiling. However, when they are installed, it is common practice with most tiles to space them apart by a small distance. This compensates for small variations in the dimensions of individual tiles. The space between tiles is then filled with a hard adhesive cement or grout. This will generally be smoothed out at a level slightly below the tile surface so that wear occurs only on the tile surface. The grout surface is not as impervious to soiling as the tile surface. Furthermore, dirt tends to flow to the lower level of the grout. Consequently, it is often more necessary to clean the grout than the tile of a tile floor. However, a broad scrubber, such as a conventional floor brush, will apply most scrubbing action to the tiles and not the grout spaces between the tiles which are most in need of scrubbing. It will require more time and energy than a scrubber which would apply most or all of the scrubbing action to the grout.

SUMMARY OF THE INVENTION

It is accordingly an object of the invention to provide a scrubbing implement in which all or most of the scrubbing action is directed to the grout between the tiles.

The scrubber of the invention comprises a plurality of linear scrubbing elements, each having a width only slightly greater than the greatest width of the usual grout lines. The scrubbing elements are adjustably spaced apart and parallel, so that the user may adjust the spacing between linear scrubbing elements to correspond to the actual grout line spacing of the floor to be scrubbed. When so adjusted and then used to scrub the tile floor, most of the scrubber action can be directed to the grout lines where most needed.

These and other objects, advantages and features of the invention will become more apparent when the detailed description is considered in conjunction with the drawings.

BRIEF DESCRIPTION OF THE DRAWINGS

FIG. 1 is a perspective view of a tile grout scrubber of the invention.

FIG. 2 is a sectional view taken through line 2—2 of FIG. 1.

FIG. 3 is a perspective view of another embodiment of the invention.

FIG. 4 is a sectional view taken on line 4—4 of FIG. 3.

FIG. 5 is a perspective view of another embodiment of the invention.

FIG. 6 is a perspective view of an electrically driven tile grout scrubber of the invention.

FIG. 7 is a sectional view taken on line 7—7 of FIG. 6.

DETAILED DESCRIPTION OF PREFERRED EMBODIMENTS

Referring now first to FIGS. 1 and 2, the grout scrubber comprises a base 1 and a long handle 2. The connection 3 of handle to base may be fixed at an angle or pivotally mounted. A plurality of long, narrow brush elements 4, each comprising a long narrow frigid housing 8 with several rows of downwardly directed bristles are slidably mounted upon base 1 such that they remain parallel to one another on their long axes yet may be spaced apart to correspond to the spacing of grout lines 5 of tile floor 6. Thumbscrews 7 threadably engaged in brush housing 8 may be advanced to press against base 1 and lock the brush elements 4 in any desired spacing.

Referring now to FIGS. 3 and 4, an alternative structure for maintaining the brush elements 4 in spaced apart, parallel relation on base 1. The T bar portion 9 of brush element 4 slidably engages slot 10 of base 1 to thereby maintain the brush elements parallel to one another. The brush elements are adjusted to an inter-brush spacing corresponding to the grout Spacing of the tile floor to be scrubbed. When so adjusted, the positioning of the brush elements may be removably fixed by forcing long, rubber-coated steel bar 11, resting in groove 12 of base 1 against the T bar portion 9 of all the brush elements. The two thumbscrews 13 threadably engaged in base 1 force the bar 11 downward for this locking function. As shown in phantom, a piece of foam sponge 14 may be cut to fit each interspace and be adhesively attached to the base 1 between the brushes to provide for cleaning the tile gently while simultaneously scrubbing the grout.

Referring now to FIG. 5, another embodiment employs sponge or fibrous scrubbing elements 15, well known in the scrubbing and cleaning art, each attached to an element housing 16. Each housing 16 is arranged to fit slidingly in slot 17 in base 1 with boss 18 maintaining the housings parallel to one another. The washers 19 and wingnuts 20 lock the elements in place after adjustment by engaging bolts 28 on housings 16.

Referring now to FIGS. 6 and 7, an electrically operated grout scrubber 21 has an electric motor 22 affixed to spray guard housing 23. The motor rotates shaft 24 which is supported by bearings 25 also affixed to housing 23. Narrow rotary brushes 26 are secured to the shaft by nuts 27 threadably engaged on the shaft. The two outboard brushes may be adjustably spaced apart from the center brush as required by a particular grout spacing by the use of these nuts on both sides of each rotary brush.

The narrow scrubbing elements, whether manual or electrically powered, tend to fit into the depressed grout recesses, so that the scrubber is substantially self-guided as it is moved along the floor, with the scrubbing effort concentrated, on the grout.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A grout scrubber for scrubbing a plurality of parallel grout lines between floor tiles simultaneously, the scrubber comprising:

a plurality of individual scrubbing elements, each element having a rigid housing means and extending downwardly therefrom a long, narrow, resilient scrubbing member having a front face wider than the width of said grout lines and opposed sides substantially longer than said front face;

a base means having a front face substantially wider than the distance between adjacent parallel grout lines;

a handle attached to said base means and extending upwardly therefrom; and mounting means for adjustably mounting said housing means on said base means with said scrubbing members extending downwardly and said sides maintained parallel to one another and spaced apart to correspond to said distance between adjacent grout lines.

2. The scrubber according to claim 1 further comprising securing means for removably fixing said housing means on said base means to maintain a particular spacing between said scrubbing members during use.

3. The scrubber according to claim 2, in which said scrubbing member is a plurality of bristles comprising a long, narrow brush.

4. The scrubber according to claim 1, in which said scrubbing member is a plurality of bristles comprising a long, narrow brush.

5. The scrubber according to claim 2, in which said scrubbing member is comprised of a foam scrubbing material.

6. The scrubber according to claim 1, in which said scrubbing member is comprised of a foam scrubbing material.

7. The scrubber according to claim 2, in which said scrubbing member is comprised of a fibrous scrubbing material.

8. The scrubber according to claim 1, in which said scrubbing member is comprised of fibrous scrubbing material.

9. A grout scrubber for scrubbing a plurality of parallel grout lines between floor tiles simultaneously, the scrubber comprising:

a housing having a front face substantially wider than the distance between adjacent parallel parallel grout lines;

a handle extending upward from said housing;

an electric motor attached to said housing;

a rotary shaft driven by said motor, said shaft rotatably mounted on said housing parallel to said front face;

a plurality of resilient, rotary scrubbing means, each having a width greater than the width of a grout line, a diameter substantially greater than said width, and a center hole; and mounting means for adjustably mounting said scrubbing means on said shaft for rotation therewith and parallel to one another and spaced apart to correspond to said distance between adjacent grout lines.

10. The scrubber according to claim 9, in which said rotary scrubbing means are bristle brushes.

11. The scrubber according to claim 9, in which said scrubbing means are comprised of foam scrubbing material.

12. The scrubber according to claim 9, in which said scrubbing means are comprised of fibrous scrubbing material.

13. A grout scrubber for scrubbing a plurality of parallel grout lines between floor tiles simultaneously, the scrubber comprising:

a plurality of individual scrubbing elements, each element having a rigid housing means and extending outwardly therefrom a long, narrow, resilient member having a front face wider than the width of said grout lines and opposed sides substantially longer than said front face, each said long, narrow, resilient scrubbing member;

a base means having a front face substantially wider than the distance between adjacent parallel grout lines;

a handle attached to said base means and extending upwardly therefrom; and mounting means for adjustably mounting said housing means on said base means with at least a portion of said scrubbing members extending downwardly below,said base means and said sides maintained parallel to one another and spaced apart to correspond to said distance between adjacent grout lines.

14. The scrubber according to claim 13, in which said scrubbing member is a plurality of bristles comprising a long, narrow brush.

15. The scrubber according to claim 13, in which said scrubbing member is comprised of a foam scrubbing material.

16. The scrubber according to claim 13, in which said scrubbing member is comprised of fibrous scrubbing material.

17. The scrubber according to claim 13, further comprising:

a shaft rotatably mounted on said base means, said shaft having an axis parallel to said front face;

an electric motor mounted in said base means for rotatably driving said shaft; and each said scrubbing member having a circular configuration and being mounted parallel to one another on said shaft for rotary motion thereon.

* * * * *